US005217091A

United States Patent [19]

Shiina et al.

[11] Patent Number: 5,217,091

[45] Date of Patent: Jun. 8, 1993

[54] MECHANICAL OVERSPEED SAFETY DEVICE

[75] Inventors: Tsutomu Shiina, Kawasaki; Eiji Narumi, Tokyo, both of Japan

[73] Assignee: Otis Elevator Company, Farmington, Conn.

[21] Appl. No.: 963,774

[22] Filed: Oct. 20, 1992

[51] Int. Cl.[5] ..... B66B 1/26

[52] U.S. Cl. ..... 187/38; 187/77; 187/79

[58] Field of Search ..... 187/77, 78, 79, 38, 187/82, 83, 84, 88, 89

[56] References Cited

U.S. PATENT DOCUMENTS

| | | | |
|---|---|---|---|
| 1,581,459 | 4/1926 | Lindquist | 187/88 X |
| 1,934,508 | 11/1933 | McCormick | 187/89 |
| 1,937,035 | 11/1933 | Dunlop | 187/89 |
| 2,244,893 | 6/1941 | Panter | 187/38 |
| 3,327,811 | 6/1967 | Mastroberte | 187/38 |

*Primary Examiner*—D. Glenn Dayoan
*Assistant Examiner*—Dean A. Reichard
*Attorney, Agent, or Firm*—Richard D. Getz

[57] ABSTRACT

An overspeed device is provided for an elevator system having an elevator car for travel within a hoistway along a guiderail. The elevator includes a governor rope running from an upper sheave at the top of the hoistway to a governor sheave at the bottom of the hoistway. The overspeed device comprises a centrifugal actuator and a gripping apparatus. In the event of an overspeed condition, the actuator actuates the gripping apparatus which in turn grips the governor rope exiting the governor sheave upwardly toward the upper sheave. The rope, now moving relative to the elevator car, operates a safety attached to the elevator car, thereby safely stopping the car.

4 Claims, 3 Drawing Sheets

MECHANICAL OVERSPEED SAFETY DEVICE

TECHNICAL FIELD

This invention relates to elevators and more specifically to overspeed governors therefore.

BACKGROUND ART

Hydraulic elevators typically comprise an elevator car, a sheave, a hydraulic cylinder, and a rope positioned inside a hoistway. One end of the rope is fixed to the car. From the car, the rope travels upward in the hoistway to the sheave. The sheave is attached to the rod end of the hydraulic cylinder. The rope wraps around the sheave and returns back down the hoistway, attaching at the other end to the bottom of the hoistway. The hydraulic cylinder propels the car through the hoistway indirectly by moving the sheave up and down the hoistway. Since the rope is a finite length, changing the position of the sheave changes the position of the car in the hoistway.

For safety reasons, elevators are generally required to have an overspeed governor and safeties. A typical overspeed governor includes a governor rope extending the length of the hoistway, attached to a sheave at the top of the hoistway and a governor sheave at the bottom of the hoistway. The governor rope is fixed to the elevator car by a linkage extending from the rope to a pair of safeties attached to the car. Because of the fixed relationship, the car and the rope are normally stationary relative to each other.

With this type of governor, if the downward velocity of the elevator exceeds a predetermined limit, i.e., an overspeed condition, a centrifugal flyweight assembly driven by the governor sheave swings outwardly and operates a governor brake. The governor brake applies a frictional drag force to the governor rope, thereby actuating a pair of safeties attached to the elevator car. The safeties act on a pair of guiderails and the car is consequently brought to a stop safely. Mastroberte U.S. Pat. No. 3 327,811 discloses such an arrangement.

This style overspeed governor, although effective, protects against overspeed conditions in one direction only. Specifically, a device like that disclosed by Mastroberte only works if the rope is traveling in a downward direction relative to the governor brake which acts on the rope. To use this type of governor, therefore, it is necessary to either position the governor sheave in a room at the top of the hoistway or to adopt a more elaborate roping scheme which would allow a Mastroberte type governor to be implemented in the pit of the hoistway. Neither of these solutions is very attractive, however. One of the great advantages of a hydraulic elevator is that no machine room is required at the top of the hoistway. Positioning a governor at the top of the hoistway would eliminate this advantage. A more elaborate roping scheme, on the other hand, would require additional sheaves and a longer rope. These additional items require greater initial cost, greater maintenance, and more clutter in the hoistway.

DISCLOSURE OF THE INVENTION

It is therefore an object of the present invention to provide a mechanical overspeed device for use in the pit of an elevator capable of stopping an elevator.

According to the present invention, an overspeed device is provided for an elevator system having an elevator car for travel within a hoistway along a guiderail. The elevator includes a governor rope running from an upper sheave at the top of the hoistway to a governor sheave at the bottom of the hoistway. The overspeed device comprises a centrifugal actuator and a gripping means. In the event of an overspeed condition, the actuator actuates the gripping means which in turn grips the governor rope exiting the governor sheave upwardly toward the upper sheave. The rope, now moving relative to the elevator car, operates a safety attached to the elevator car, thereby safely stopping the car.

An advantage of the present invention is that it provides a mechanical overspeed device capable of operating in the pit of a hydraulic elevator with a roping scheme involving only two sheaves.

These and other objects, features and advantages of the present invention will become more apparent in light of the detailed description of the best mode embodiment thereof, as illustrated in the accompanying drawings.

BEST MODE FOR CARRYING OUT THE INVENTION

Figure 1:
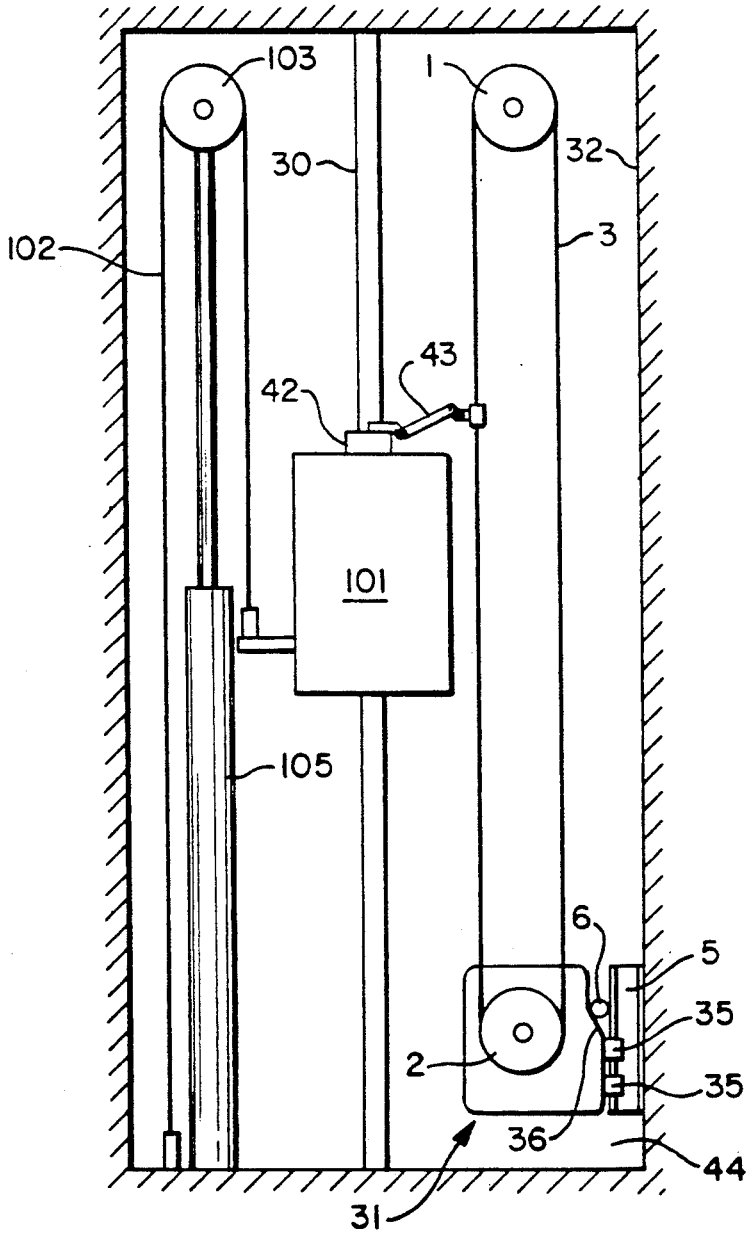
FIG. 1 is a diagrammatic view of a hydraulic elevator with a governor positioned in a hoistway.

Referring to FIG. 1, an elevator comprises an elevator car 101, a guiderail 30, a governor sheave 2, an upper sheave 1, a cylinder sheave 103, a governor rope 3, and an overspeed device 31 arranged within a hoistway 32. It is known in the art that there is a fixed relationship between the elevator car 101 and the governor sheave 2 such that the linear motion of the car 101 is translated into rotational motion of the governor sheave 2. Generally speaking, the fixed relationship is created by fixedly attaching the elevator car 101 to the governor rope 3 as is known in the art.

Figure 2:
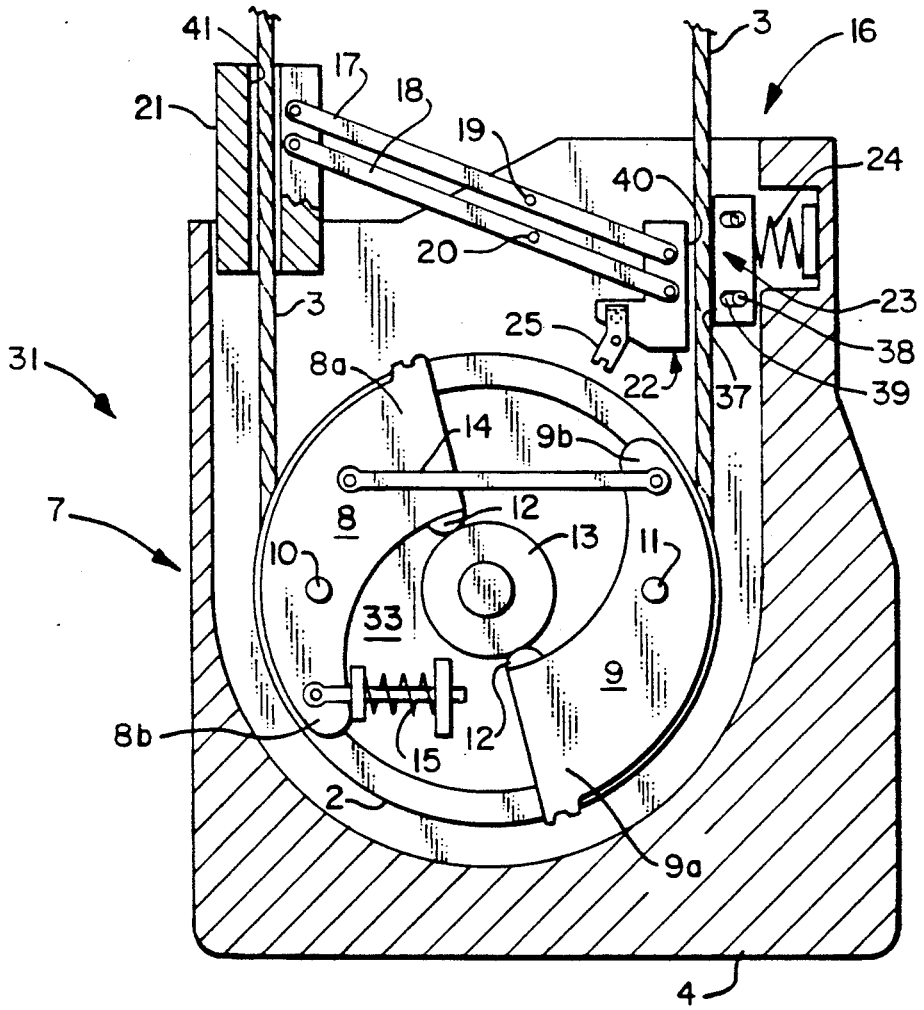
FIG. 2 shows a centrifugal actuator attached to a governor sheave, both of which are attached to a tensioning weight.

Referring to FIG. 2, an overspeed device 31 includes a centrifugal actuator 7 attached to the governor sheave 2. The actuator 7 has a pair of identical weights 8,9 rotatably mounted on pins 10,11 which are fixed to the web 33 of the governor sheave 2. Each pin 10,11 is received by a weight 8,9 in between a massive portion **8*a*,9*a* and an extending arm 8*b*,9*b* portion of the weight 8,9, thereby enabling each portion to rotate about the pin 10,11. The massive portion 8*a*,9*a* will always be the heavier portion of each weight 8,9. A spring 15 urges the massive portion 8*a* of one of the weights 8 to rotate radially inward about the pin 10. A flexible contact unit 12 attached to the inner surface of each massive portion 8*a*,9*a* rests against the rotational axle 13 of the sheave 2. Rotation of the sheave 2 causes the massive portions 8*a*,9*a* to be urged by centrifugal forces to fly radially outward, against the urging of the spring 15. A tie rod 14 interconnects the weights 8,9** forcing them to act in unison.

Figure 3A:
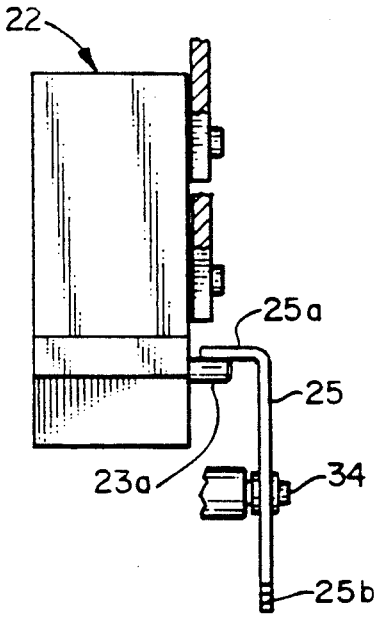
FIG. 3A is a side view of the latch shown in FIG. 3.
Figure 3:
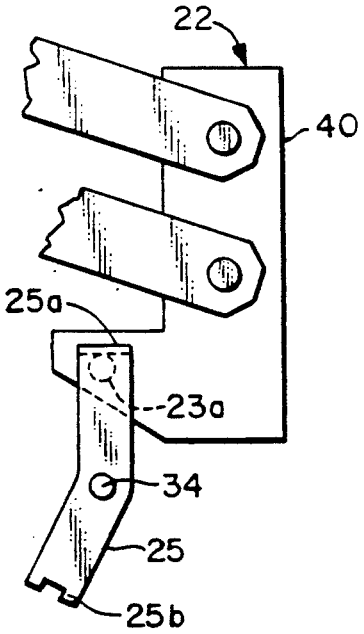
FIG. 3 is a close up view of the latch shown in FIG. 2.

Referring to FIGS. 2, 3 and 3A, a latch 25 is pivotly pinned to a tensioning weight 4 attached to the governor sheave 2. The latch 25 is aligned in the rotational plane of the weights 8,9 mounted on the centrifugal actuator 7. The latch 25 consists of a hook section 25*a* and a lug section 25*b*. A pin 34 is received by the latch 25 in between the hook 25*a* and lug 25*b* sections, thereby enabling the hook 25*a* and lug 25*b* sections to pivot about the pin 34.

Referring to FIG. 1, the tensioning weight 4 attached to the governor sheave 2 includes a pair of slides 35 which are shaped to receive a guide 5. The guide 5, which is attached to the hoistway 32, limits the motion of the governor sheave 2 and tensioning weight 4 to vertical motion. The tensioning weight 4 further comprises a tapered section 36 facing the guide 5. A roller 6 is positioned between the tapered surface 6 and the guide 5.

Referring to FIG. 2, a gripping means 16 for gripping the rope 3 in the event of an overspeed condition is attached to the tensioning weight 4 above the centrifugal actuator 7. The gripping means 16 includes a stationary jaw 23, a swinging jaw 22, a free weight 21, and a pair of pivotly mounted links 17,18 connecting the free weight 21 and the swinging jaw 22. The stationary jaw 23 consists of a brake surface 37, a pair of pins 38 for holding the brake surface 37 to the tensioning weight 4, and a spring 24. The pins 38 are received by a pair of slots 39 in the brake surface 37. The spring 24 biases the brake surface 37 in the direction of the rope 3 which extends between the stationary jaw 23 and the swinging jaw 22. During normal operation, the pins 38 prevent the brake surface 37 from contacting the rope 3. The swinging jaw 22 consists of a brake surface 40 pivotly mounted to the links 17,18 which connect the swinging jaw 22 and the free weight 21. A rod 23*a* extends out from a side of the brake surface 40. The free weight 21 is also pivotly connected to the links 17,18. On the side of the governor sheave 2 opposite the stationary jaw 23, the rope 3 extends through a bore 41 in the center of the free weight 21. Referring to FIGS. 1 and 2, in the operation of a hydraulic elevator having an elevator car 101 propelled through a hoistway 32 by a hydraulic cylinder 105, an elevator car rope 102 may break causing the car 101 to descend at an unsafe speed, which may be described as an overspeed condition. In the event of an overspeed condition, i.e. when the rotational speed of the governor sheave 2 exceeds a predetermined amount, the pivotally mounted weights 8,9 comprised within the centrifugal actuator 7 overcome the force of the spring 15 which biases the pivotly mounted weights 8,9 against the rotational axle 13 of the governor sheave 2. As a result, the weights 8,9 pivot radially outward and displace the pivotly mounted latch 25.

During normal operation, the rod 23A extending out from the swinging jaw 22 is biased against the hook section 25*a* of the latch 25 by the free weight 21 attached to the other end of the links 17,18. The swinging jaw 22 is consequently maintained out of contact with the rope 3. When the lug section 25*b* of the latch 25 is struck by the massive portions 8*a*,9*a* of the actuator 7, however, the latch 25 pivots and releases the swinging jaw 22. The free weight 21 on the other end of the links 17,18 drops downward, pivoting about the pins 19,20 that hold the links 17,18 to the tensioning weight 4. The swinging jaw 22 attached to the other end of the links 17,18 is pivoted into contact with the rope 3 which is traveling upward, away from the governor sheave 2. The direction of the rope travel and the weight of the free weight 21 combine to pivot the swinging jaw 22 still further, now causing the swinging jaw 22 to displace the rope 3 in the direction of the stationary jaw 23. The stationary jaw 23, in turn, is pushed toward the spring 24, thereby compressing the spring 24. The swinging jaw 22 stops pivoting when it is aligned with the stationary jaw 23. At that point, the gripping force exerted on the rope 3 by the jaws 2,23 is the force of the spring 24 biasing the stationary jaw 23 in the direction of the rope 3 and the now aligned swinging jaw.

As the car 101 continues to descend, the gripping force on the rope 3 causes the car 101 and the rope 3 to move relative to one another. Normally, the car 101 and the rope 3 are stationary relative to one another. As a result, the linkage 43 attached to the governor rope 3 is dragged upward, away from the elevator car 101. Dragging the linkage 43 upward causes the linkage 43 to operate the safeties 42 attached to the elevator car 101, thereby safely stopping the car 101. Mastroberte U.S. Pat. No. 3,327,811 discloses that a linkage may be attached to a governor rope 3 which actuates a safety attached to the elevator car 101. The present invention is directed principally to the overspeed device claimed.

When the gripping means 16 applies a force to the rope 3, the weight of the elevator car 101 attached to the rope 3 on the other side of the sheaves 1,2 will tend to pick up the governor sheave 2 and tensioning weight 4. The slides 35 attached to the tensioning weight 4 and in register with the guide 5 limit the movement of the tension weight 4 and governor sheave 2 to up and down in the hoistway 32. The slides 35 and guide 5 prevent the tension weight 4 from gross movement which could damage other equipment in the pit 44 or cause the governor to fail. If the upward movement of the tensioning weight 4 is too great, the roller 6 positioned between the tapered surface 36 of the tensioning weight 4 and the guide 5 will bind and prevent the tensioning weight 4 from traveling further up the hoistway 32.

Although this invention has been shown and described with respect to the detailed embodiments thereof, it will be understood by those skilled in the art that various changes in form and detail thereof may be made without departing from the spirit and scope of the claimed invention.

We claim:

1. An overspeed device for an elevator system, having an elevator car for travel in a hoistway along a guiderail, and a governor rope passing over an upper sheave at the top of the hoistway and a governor sheave at the bottom of the hoistway, and a safety brake in communication with the rope for stopping the car, comprising:

a centrifugal actuating means, attached to the governor sheave;

a pivotly mounted latch; and a gripping means, for gripping the rope, wherein in the normal operation of the elevator, said latch prevents said gripping means from gripping the rope, but in an overspeed condition said actuating means actuates said latch, thereby causing said latch to allow said gripping means to grip said rope exiting the governor sheave upwardly toward the upper sheave, causing said rope to operate the safety brake attached to the car.

2. An overspeed device for an elevator system, having, an elevator car for travel in a hoistway along a guiderail, and a governor rope passing over an upper sheave at the top of the hoistway and a governor sheave at the bottom of the hoistway, and a safety brake in communication with the rope for stopping the car, comprising:

a centrifugal actuating means, attached to the governor sheave;

a pivotly mounted latch; and a gripping means, for gripping the governor rope, comprising a stationary jaw positioned on one side of the rope and a swinging jaw positioned on the other side of the rope, said swinging jaw connected to a free weight by a pivotly mounted link, wherein an overspeed condition will cause said actuating means to displace said latch, thereby enabling said free weight to fall and consequently allow the rope exiting the governor sheave upwardly toward the upper sheave, to be gripped between said swinging jaw and said stationary jaw, and said safety to stop the car.

3. An overspeed device for an elevator system according to claim 2, further comprising:

a tensioning weight, attached to the governor sheave having a tapered surface;

a guide, attached to the hoistway for guiding the motion of said tension weight and the governor sheave; and a roller, positioned between said guide and said tapered surface of said tensioning weight, such that gross vertical movement of said tensioning weight and governor sheave in the hoistway will cause said roller to bind between said tapered surface and said guide, thereby preventing said tensioning weight and governor sheave from further upward vertical movement in the hoistway.

4. A governor for use with an elevator having an elevator car propelled through a hoistway by a hydraulic cylinder, wherein the hoistway includes a top and a pit, and a guiderail for guiding the elevator car, and the elevator car includes safeties for stopping the car, comprising:

an upper sheave, positioned in the top of the hoistway;

a governor sheave, positioned in the pit of the hoistway;

a rope, formed in a loop extending from said upper sheave to said governor sheave;

a centrifugal actuating means, attached to said governor sheave; and a gripping means, for gripping said rope, wherein an overspeed condition will cause said actuating means to actuate said gripping means, thereby causing said gripping means to grip said rope exiting said governor sheave upwardly toward said upper sheave, causing said rope to operate the safeties attached to the car.

* * * * *